US005653306A

United States Patent [19]

Bendickson et al.

[11] Patent Number: 5,653,306

[45] Date of Patent: Aug. 5, 1997

[54] LADDER SYSTEM INCLUDING A CASTER BRACKET AND METHOD OF FORMING

[75] Inventors: Roy B. Bendickson; Jay P. Smith, both of Greenville, Pa.

[73] Assignee: Werner Co., Greenville, Pa.

[21] Appl. No.: 611,281

[22] Filed: Mar. 6, 1996

Related U.S. Application Data

[63] Continuation of Ser. No. 106,045, Aug. 12, 1993, abandoned.

[51] Int. Cl.[6] ..... E06C 5/00

[52] U.S. Cl. ..... 182/15; 182/17; 16/29

[58] Field of Search ..... 182/15, 17; 16/29

[56] References Cited

U.S. PATENT DOCUMENTS

| | | | |
|---|---|---|---|
| 1,226,894 | 5/1917 | Koehler | 16/29 |
| 1,635,389 | 7/1927 | Shuffleton | 16/29 |
| 2,314,478 | 3/1943 | Brower | 182/15 X |
| 2,521,114 | 9/1950 | Campbell | 182/12 X |
| 2,800,679 | 7/1957 | Schultz | 16/29 |
| 5,148,889 | 9/1992 | Fenwick | 182/17 |

FOREIGN PATENT DOCUMENTS

| | | | |
|---|---|---|---|
| 903771 | 8/1967 | United Kingdom | 182/15 |

*Primary Examiner*—Alvin C. Chin-Shue
*Attorney, Agent, or Firm*—Ansel M. Schwartz

[57] ABSTRACT

A ladder system comprising a ladder having side rails and a plurality of steps disposed between the side rails. The ladder system also is comprised of at least one corner brace for supporting a bottom step of the ladder. The corner brace is attached to a side rail of the ladder and the bottom step. Additionally, the ladder system is comprised of at least one caster assembly integrally attached to the corner brace for allowing the ladder to roll. Preferably, the caster assembly and corner brace are disposed on the ladder such that a predetermined weight placed on the ladder prevents the ladder from rolling. The corner brace is preferably comprised of a first portion, a second portion connected to the first portion and a third portion connected to the second portion. The first portion is attached to a bottom of the ladder. The second portion is attached to the caster assembly. Additionally, the third portion is attached to a rail of the ladder. A caster apparatus comprises a corner brace for supporting a bottom step of a ladder. The caster apparatus is also comprised of a caster assembly integrally attached to the corner brace for allowing the ladder to roll. A method for forming a ladder system. The method comprises the steps of attaching a caster assembly to a corner brace for a ladder such that the caster assembly is in biased sliding relationship with the corner brace. Then, there is the step of fixing the corner brace having the caster assembly to a bottom step of the ladder and to a side rail of the ladder such that the rail is maintained off of ground by the caster assembly when there is essentially no weight on the ladder. Preferably, after the fixing step, there is the step of rolling the ladder on the caster assembly to a desired location.

17 Claims, 7 Drawing Sheets

LADDER SYSTEM INCLUDING A CASTER BRACKET AND METHOD OF FORMING

This application is a continuation of application Ser. No. 08/106,045 filed on Aug. 12, 1993, now abandoned

FIELD OF THE INVENTION

The present invention pertains to a ladder system. More specifically, the present invention pertains to a ladder system having a caster apparatus that includes a corner brace and a caster assembly hingedly attached to the corner brace. The corner brace serves the dual function of supporting a bottom step of a ladder of the ladder system and supporting the caster assembly.

BACKGROUND OF THE INVENTION

Ladders, such as stepladders, have used caster assemblies to facilitate the movement of the ladders by users. Instead of having to lift or drag a ladder to move it, the ladder moved by rolling it on casters. When ladder casters are put in place on the ladder, typically holes are introduced into the rails of the ladder. These holes weaken the structural integrity of the rail and thus the strength of the ladder itself.

The present invention utilizes a corner brace of a ladder to position a caster assembly onto a ladder. No additional holes other than the holes for the corner brace are necessary. The corner brace serves the dual purpose of supporting the bottom step of the ladder as well as the caster assembly.

SUMMARY OF THE INVENTION

The present invention pertains to a ladder system. The ladder system comprises a ladder having side rails and a plurality of steps disposed between the side rails. The ladder system also is comprised of at least one corner brace for supporting a bottom step of the ladder. The corner brace is attached to a side rail of the ladder and the bottom step. Additionally, the ladder system is comprised of at least one caster assembly integrally attached to the corner brace for allowing the ladder to roll. Preferably, the caster assembly and corner brace are disposed on the ladder such that a predetermined weight placed on the ladder prevents the ladder from rolling. The corner brace is preferably comprised of a first portion, a second portion connected to the first portion and a third portion connected to the second portion. The first portion is attached to a bottom step of the ladder. The second portion is attached to the caster assembly. Additionally, the third portion is attached to a rail of the ladder.

The present invention also pertains to a caster apparatus for a ladder. The caster apparatus comprises a corner brace for supporting a bottom step of a ladder. The caster apparatus is also comprised of a caster assembly integrally attached to the corner brace for allowing the ladder to roll.

The present invention also pertains to a method for forming a ladder system. The method comprises the steps of attaching a caster assembly to a corner brace for a ladder such that the caster assembly is in biased sliding relationship with the corner brace. Then, there is the step of fixing the corner brace having the caster assembly to a bottom step of the ladder and to a side rail of the ladder such that the rail is maintained off of ground by the caster assembly when there is essentially no weight on the ladder. Preferably, after the fixing step, there is the step of rolling the ladder on the caster assembly to a desired location.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1B:
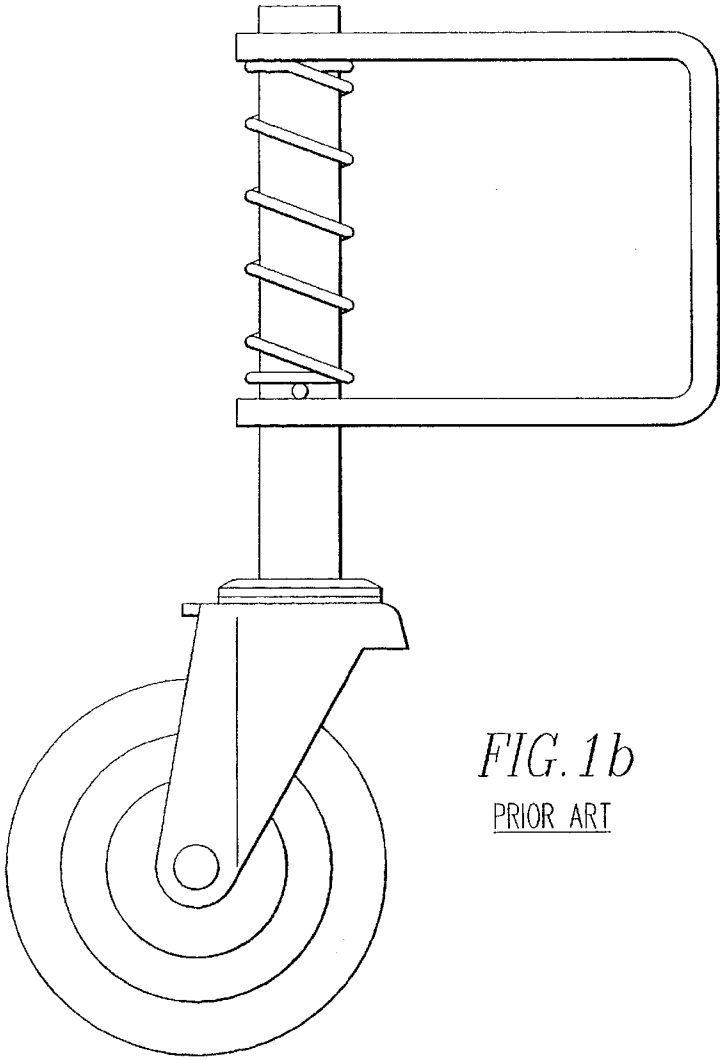
FIG. 1b PRIOR ART
FIG. 1*b* is a front view of a prior art caster assembly for a ladder.
Figure 1A:
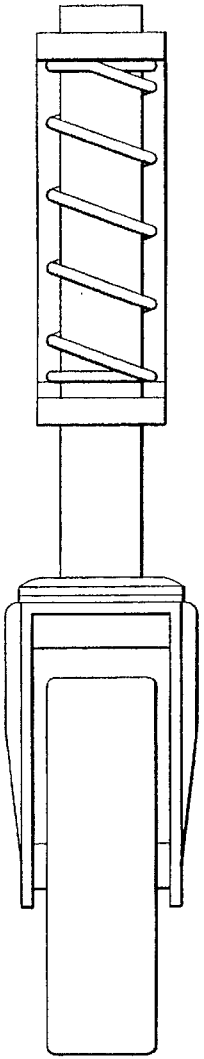
FIG. 1a PRIOR ART
FIG. 1*a* is a side view of a prior art caster apparatus for a ladder.
Figure 2:
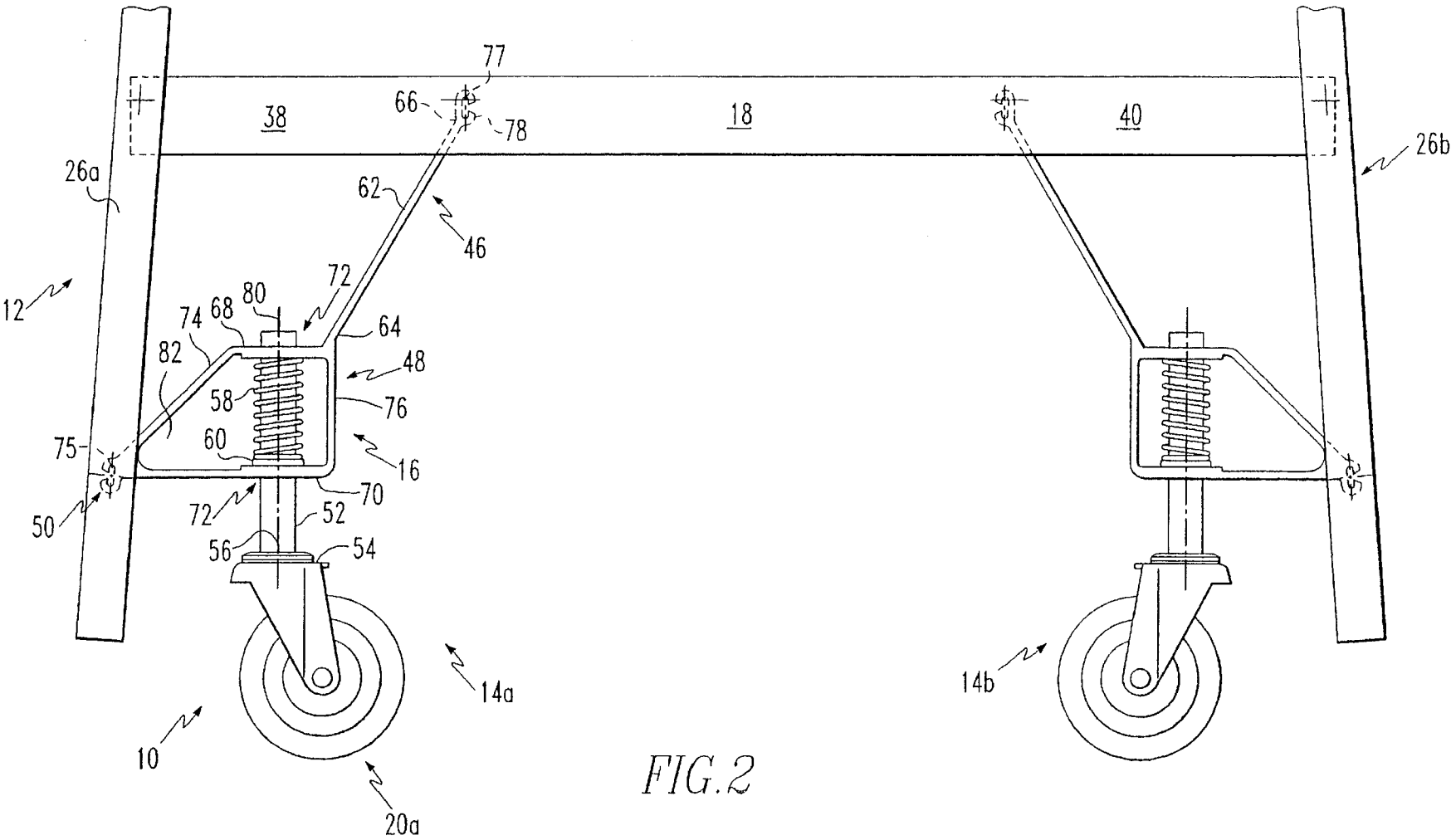
FIG. 2 is a front view of a portion of a ladder system depicting the caster apparatus of the present invention.

Referring now to the drawings wherein like reference numerals refer to similar or identical parts throughout the several views, and more specifically to FIG. 2 thereof, there is shown a ladder system 10. The ladder system 10 comprises a ladder 12 having side rails 26 and a plurality of steps 18 disposed between the side rails 26. The system is also comprised of a caster apparatus 14 for the ladder 12. The caster apparatus 14 is preferably comprised of a corner brace 16 for supporting a bottom step 18 of the ladder 12. The corner brace 16 is preferably attached to a side rail 26 of the ladder and the bottom step 18. The caster apparatus 14 is also comprised of at least one caster assembly 20 integrally attached to the corner brace 16 for allowing the ladder 12 to roll. Preferably, the caster assembly 20 and corner brace 16 are disposed on the ladder 12 such that a predetermined weight placed on the ladder 12 prevents the ladder 12 from rolling on the caster assembly 20. Preferably, the caster assembly 20 is only connected to the corner brace 16.

Figure 3:
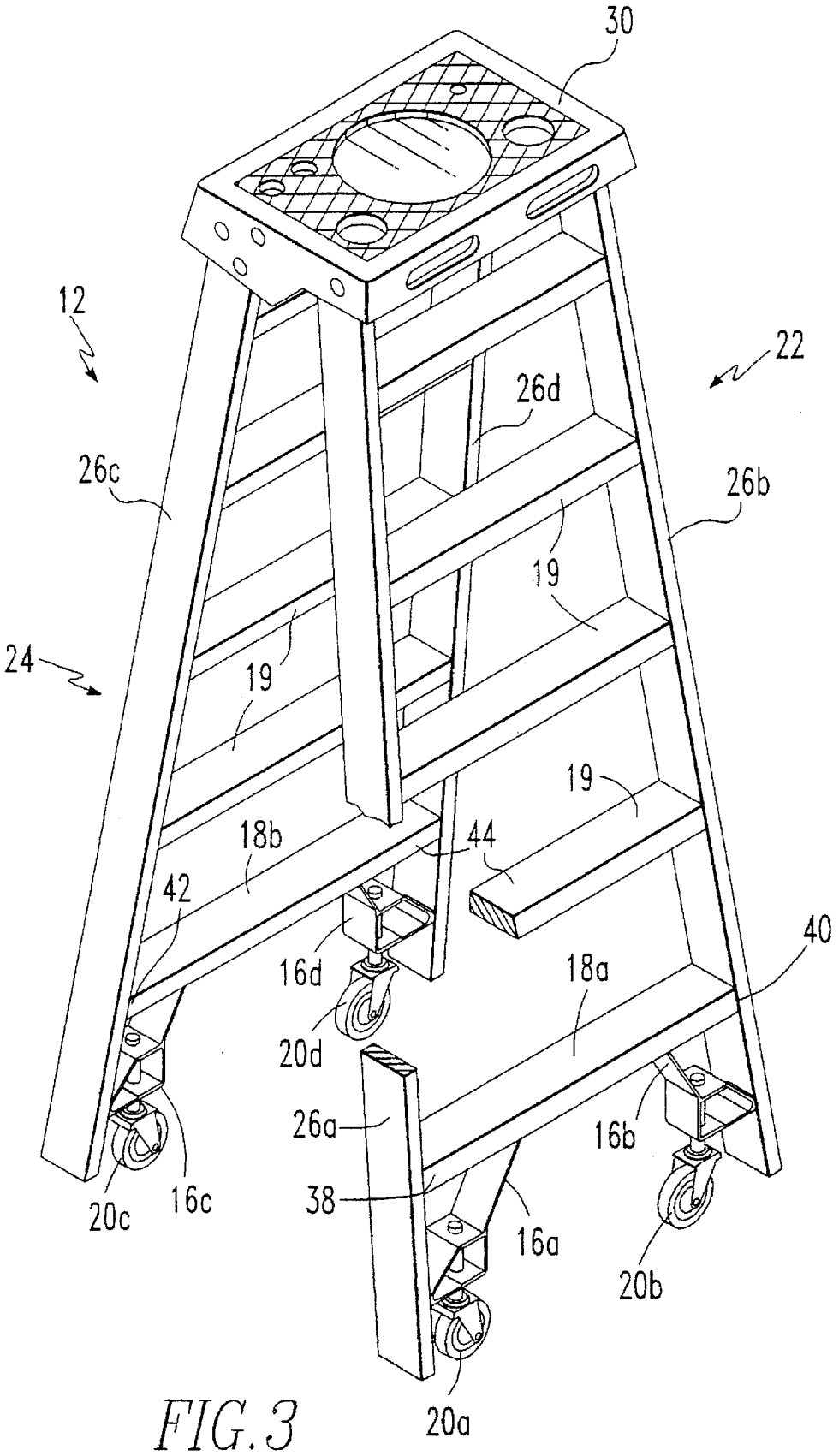
FIG. 3 is a perspective view of a ladder system of the present invention.

Preferably, the ladder 12 is comprised of a first side 22 and a second side 24, as shown in FIG. 3. The first side 22 has a first rail 26*a* and a second rail 26*b* connected by a plurality of steps 19 including the first bottom step 18*a*. The second side 24 is connected to the first side 22 preferably through a top 30 as is well known in the art. The second side 24 has a third rail 26*c* and a fourth rail 26d connected by a plurality of steps 19 including a second bottom step 18*b*. For instance, preferably, the ladder 12 can be that which is disclosed in U.S. patent application Ser. No. 07/957,988, incorporated by reference.

The first bottom step 18*a* has a first end 38 connected to a first corner brace 16*a* with a first caster assembly 20*a* and a second end 40 connected to a second corner brace 16*b* with a second caster assembly 20*b*. The second bottom step 18*b* has a first end 42 connected to a third corner brace 16*c* with a third caster assembly 20*c* and a second end 44 connected to a fourth corner brace 16*d* with a fourth caster assembly 20*d*.

Figure 4:
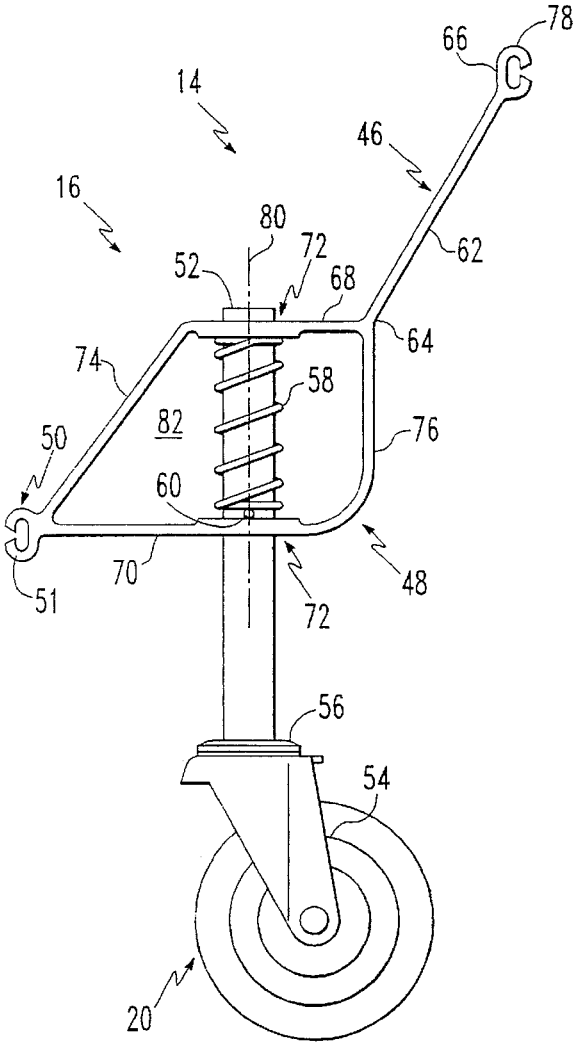
FIG. 4 is a front view of a caster assembly of the present invention.

As shown in FIG. 2 and FIG. 4, each corner brace 16 is comprised of a first portion 46, a second portion 48 connected to the first portion 46 and a third portion 50 connected to the second portion 48. The first portion 46 is attached to a bottom step 18 of the ladder 12. The second portion 48 is attached to the caster assembly 20. The third portion 50 is attached to a rail 26 of the ladder 12. Preferably, the first, second and third portions are one continuous piece made of metal.

Each caster assembly 20 preferably is comprised of a caster stem 52 extending in a supported sliding relationship through the second portion 48. Each caster assembly 20 also has a caster 54 attached to a first end 56 of the caster stem 52. Each caster assembly is comprised of a spring 58 disposed around the caster stem 52 for biasing the caster stem 52 in an extended position. Each caster assembly 20 additionally is comprised of a pin 60 connected through the caster stem 52 for compressing the spring 58 as the caster stem 52 slides through the second portion 48 as a result of weight being placed on the ladder 12. The spring 58 is contained by the pin 60 in the second portion 48.

The first portion 46 is comprised of a stem 62 having a first end 64 and a second end 66. The first end 64 is connected to and extending from the second portion 48 and the second end 66 is connected to the bottom step 18. The second portion 48 preferably is comprised of a first side 68 and a second side 70 each of which have an opening 72 through which the caster stem 52 slidably extends. The first and second sides of the second portion 48 are in spaced relationship with each other. The second portion 48 can also include a third side 74 and a fourth side 76 while are connected to the first side 68 and second side 70 and maintain the first side 68 and second side 70 in a spaced relationship. The third portion 50 can be a connector 51 which extends from the second side 70 and connects to the side rail 26. The connector 51 can be c-shaped, as shown, or o-shaped. Similarly, a connector 78 of the stem 62 at its second end 66 can be c-shaped, as shown, or o-shaped.

Figure 5:
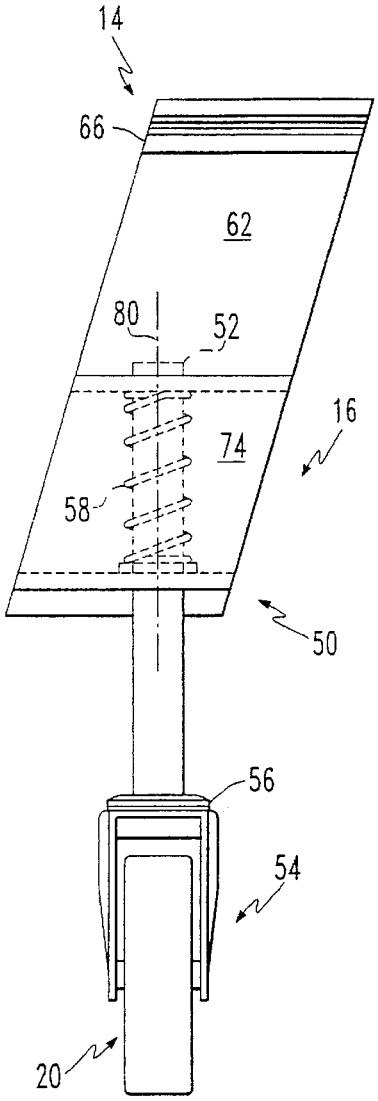
FIG. 5 is a side view of a caster assembly of the present invention.
Figure 6:
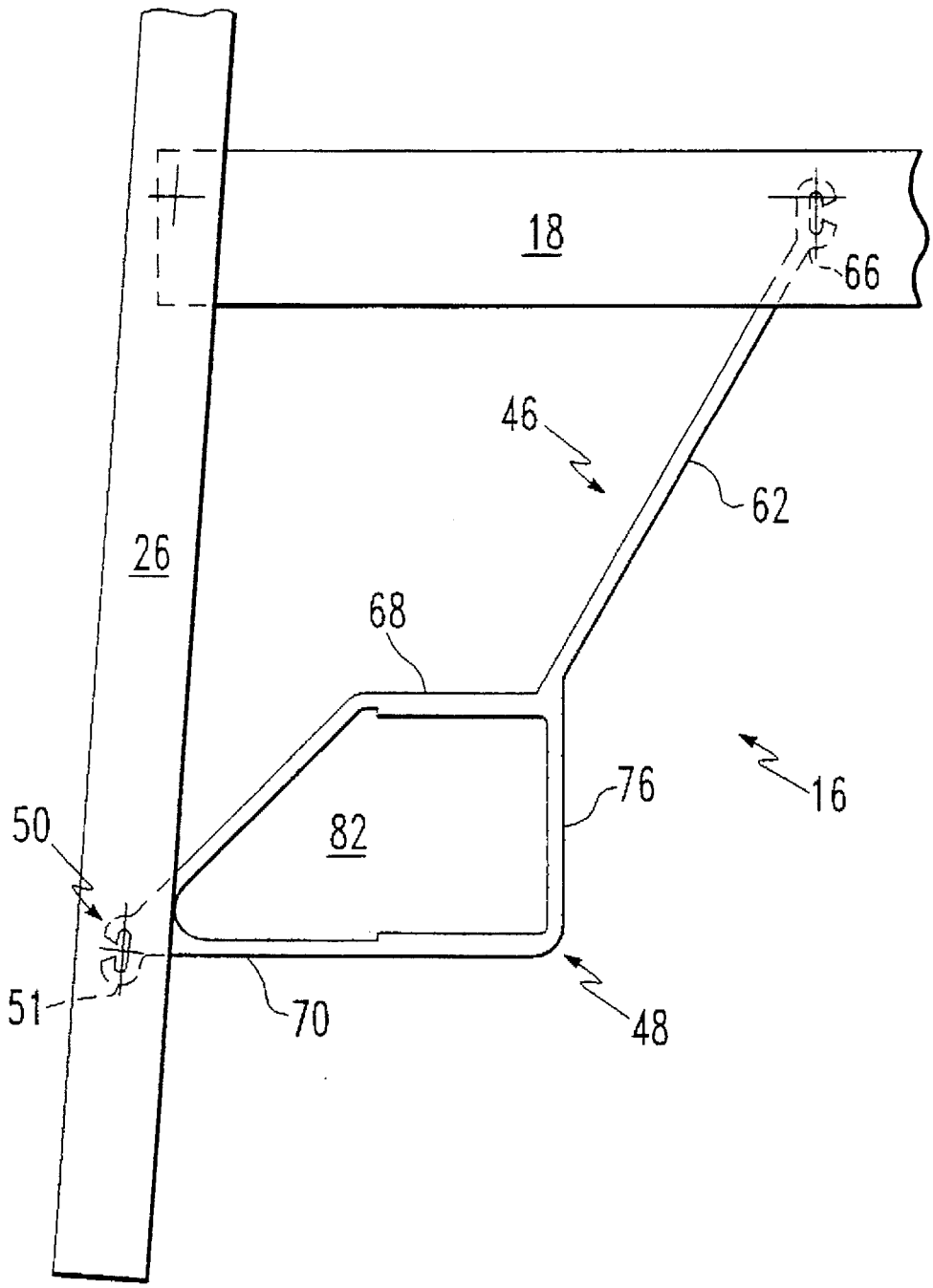
FIG. 6 is a front view of a corner brace of the present invention in position relative to a side rail and a bottom step of a ladder.
Figure 7:
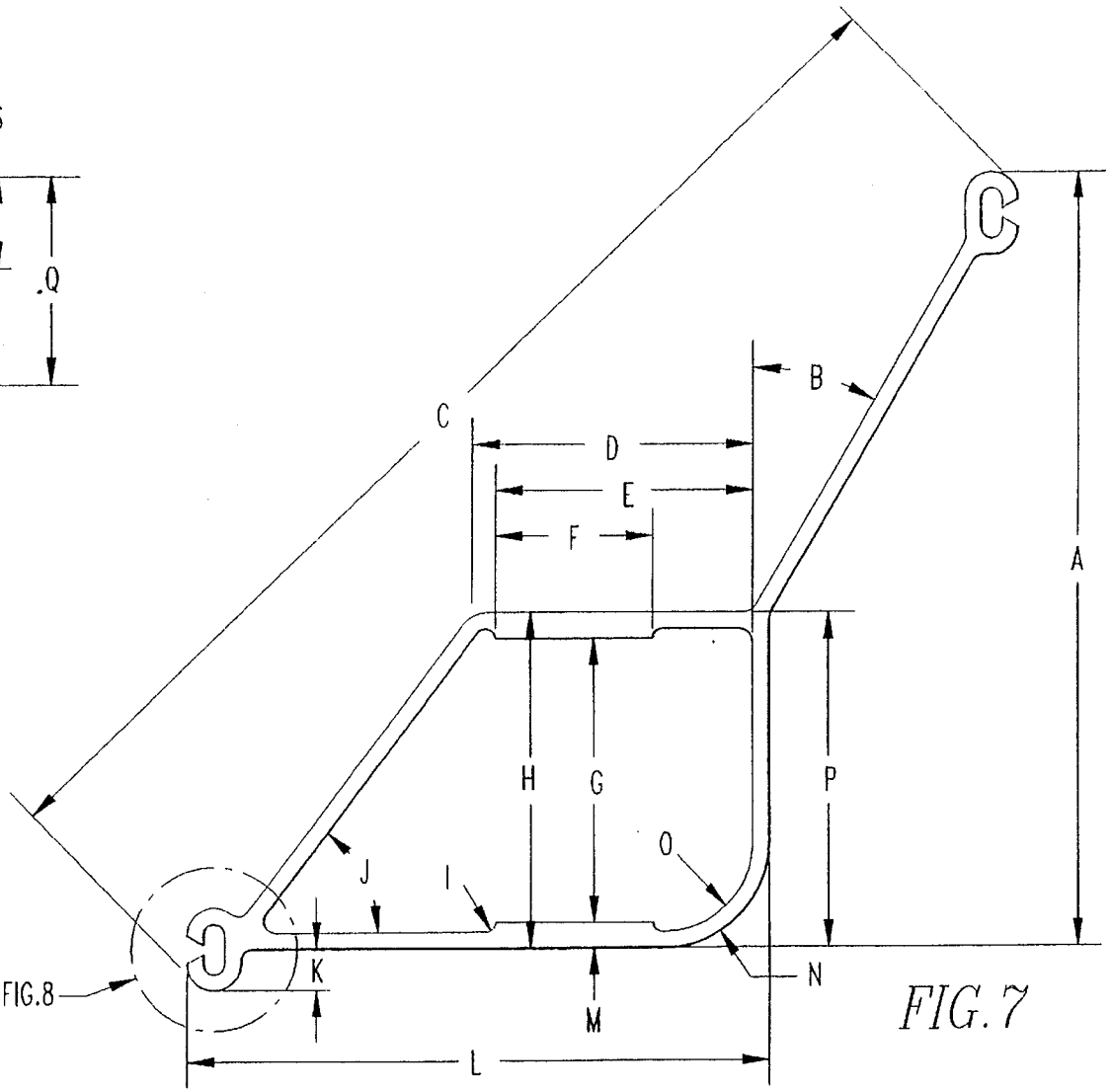
FIG. 7 is a front view of the corner brace of the present invention.
Figure 8:
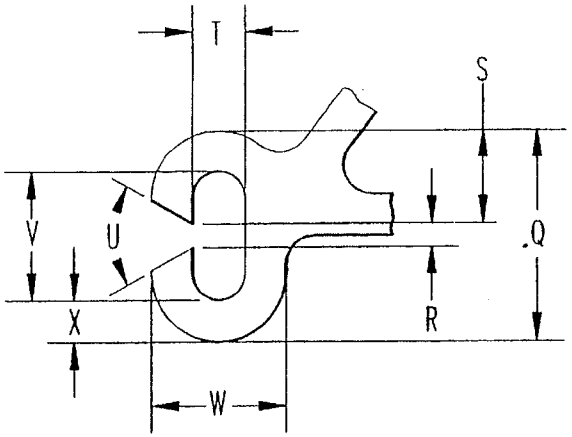
FIG. 8 is a detailed view of a connector of the third portion of the corner brace shown in FIG. 7.
Figure 9:
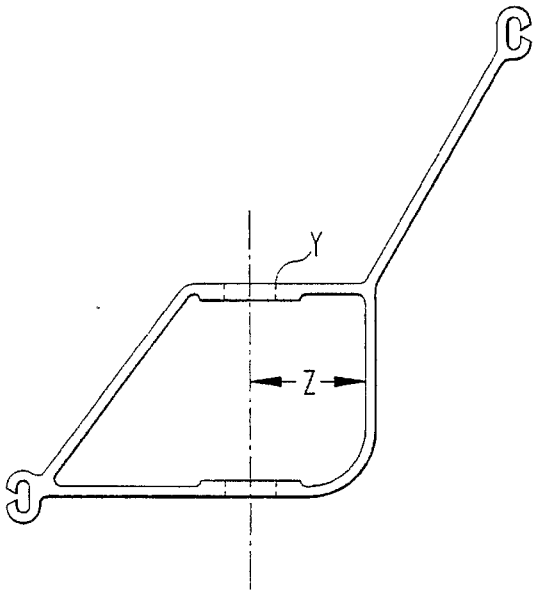
FIG. 9 is a front view of the corner brace of the present invention.
Figure 10:
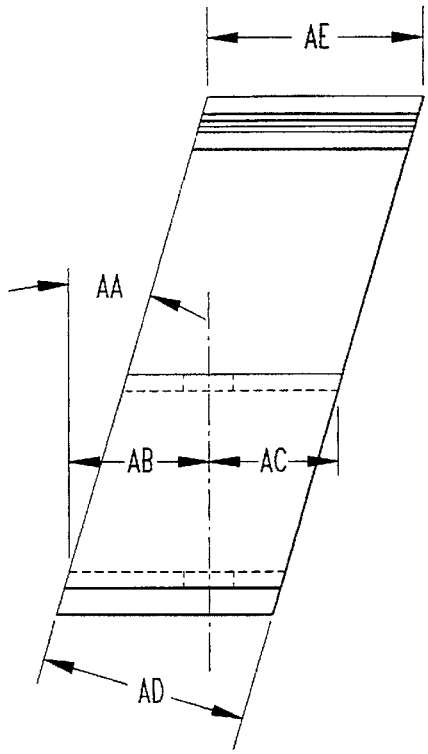
FIG. 10 is a side view of the corner brace of the present invention.

FIG. 5 shows a side view of the caster apparatus 14. Note that the corner brace 16 is at an angular offset relative to the axis 80 of the caster stem 52. This offset is so the corner brace can parallel the respective rail 26 to which it is attached, since the rail is also at an angle relative to the axis 80. FIG. 6 shows the corner brace 16 without a caster assembly 14.

In the operation of the preferred embodiment, a caster apparatus 14 is attached to each rail 26 near its bottom, and to the bottom step 18 during manufacture or by being retrofitted to an existing stepladder. When the caster apparatus 14 is attached to the ladder during manufacture, a first screw (not are shown) are inserted into the side rail 26 through hole 75 where it is received by the connector 51 of the third portion 50, as shown in FIG 2. Additionally, there is a second screw (not shown) inserted in the bottom step 18 through bottom step hole 77. The second screw is received by a connector 78 of the stem 62 at its second end 66. In the event a stepladder is retrofitted with a caster apparatus 14, then the fasteners at rail hole 75 and bottom step hole 77 are removed so that screws can be inserted into the respective holes to attach the caster apparatus 14 to the stepladder 12.

Once the caster apparatus 14 is in place on the ladder 20, the spring 58 about the caster stem 52 has a spring constant K (where K=17 lb/inch) which is great enough, in combination with the other caster apparatuses 14, to maintain the stepladder 12, with only essentially its own weight above the ground so the rail 26 do not touch the ground. This facilitates free movement of the stepladder 12 when the stepladder is rolled along the ground on the casters 54. The springs 58 maintain the ladder 12 in this off-the-ground position by each spring 58 pushing against the pin 60 that extends through the caster stem 52, and by each spring 58 pushing up against the first side 68 of the second portion 48 of the corner brace 16.

Similarly, when the stepladder 12 is placed in a desired position, a user climbs the stepladder 12 to perform his work. When the user places his weight on the bottom step 18 of the stepladder 12, this weight is transferred by the rail 26 and the stem 62 of the corner brace 16 through the first side 68 of the second portion 48, causing the first side 68 to move down and to compress the spring 58 whose bottom is maintained by pin 60 so that it cannot also move down. The stepladder 12 moves down until the rails 26 contact the ground and support most of the weight of the user. The spring 58 is maintained in a compressed state as long as there is sufficient weight upon it, such as when a user is on the ladder. During such time, the second side 70 of the second portion 48 is moved down to a point just above the caster 54 attached to the caster stem 52 at the caster stem first end 56. Accordingly, the third portion 50 of the corner brace 16 is attached to the side rail 26 at a distance (for instance, 4½ inches) such that the bottom of the rail 26 will contact the ground and support most of the weight before the second side 70 contacts the caster 54. In this way, the caster 54 will not prevent the bottom of the side rail 26 from contacting the ground sufficiently to provide a stable support for the user on the ladder 12.

The caster stem 52 is held by the corner brace 16 through opening 72 in the first side 68 and second side 70. These holes 72 are preferably aligned so that the caster stem 52 essentially is in a perpendicular position with respect to flat ground. The pin 60 which prevents the spring 58 from moving down also prevents the corner brace 16 from lifting off of the caster stem 52 and separating from the caster assembly 20. The pin 60 not only extends through the caster stem essentially perpendicular to the axis 80 of the caster stem 52 but extends out of the stem 52 so that it abuts the second side 70 when the corner brace 16 is moved upwards relative to the caster assembly 20 and stops it from moving further upward.

Corner brace 16 is of a width essentially equivalent to the width of the rail 26 to provide support to the bottom step 18 when a user places weight upon it. The bottom step 18 is not only connected to the rail at its first end 38 and second end 40, but also is connected to the rail 26 through the corner brace 16. The stem 62 of the corner brace 16 at its second end 66 is attached through a screw (not shown). The first end of the stem 64 is connected to the first side 68 and the fourth side 76 of the second portion 48. The first side 68 is in turn not only connected to the fourth side 76 but to the third side 74. The third side 74 is also connected to the second side 70. The first side 68, second side 70, third side 74 and fourth side 76 together form a pocket 82 in which the caster stem 52 of the caster assembly 20 is held and extends. The fourth side 76 and second side 70 are also connected at the third portion 50 whose connector 51 connects to the rail 26. Through the stem 62, first side 68, second side 70, third side 74 and fourth side 76 and connector 51 of the third portion 50, weight is also transferred from the bottom step 18 to the side rail 26. Moreover, weight is also transferred to the ground through the caster 54 because when there is weight on the step 18, it causes the corner brace 16 to move down such that the second side 70 rests against the caster 54 at the caster stem's first end 56. Thus, weight on the bottom step 18 is distributed to the ground through the rail 26 by way of stem 62, first side 68, third side 74 and connector 51 of the third portion 50; and to the ground through the stem 62, fourth side 76, second side 70 and connector 51. (The force of the spring 58 on the bottom step 18 is generated therefrom by way of stem 62 and first side 68 from the top of the spring 58 and by way of pin 60, stem 52 and the ground from the bottom of the spring 58). In this way, the corner brace 16 serves the dual function of supporting the bottom step 18 and also holding the caster assembly 20 in an integral fashion. It does so without weakening the ladder because no additional holes to, for instance, the rail are needed as in the prior art caster devices so they can be attached to the side rail of a ladder.

With respect to FIGS. 7, 8, 9 and 10, Table I provides preferred dimensions in inches, unless otherwise indicated for one example of many possible examples of the corner brace 16.

TABLE I

| | | | |
|---|---|---|---|
| A | 6.485 | Q | 0.710 |
| B | 29° | R | 0.156 |
| C | 9.452 | S | 0.277 |
| D | 2.277 | T | 0.157 |
| E | 2.071 | U | 60° |
| F | 1.280 | V | 0.460 |
| G | 2.500 | W | 0.407 |
| H | 2.875 | X | 0.125 |
| I | 0.063 | Y | 0.640 |
| J | 53° | Z | 1.431 |
| K | 0.355 | AA | 17° |
| L | 4.748 | AB | 1.768 |
| M | 0.188 | AC | 1.768 |
| N | 0.875 | AD | 2.650 |
| O | 0.750 | AE | 2.777 |
| P | 2.843 | | |

If the connector 51, 78 is o-shaped, then U=0 and R=0.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A caster apparatus for a ladder comprising:

a corner brace for supporting a bottom step of a ladder, said corner brace moving a housing configured to attached to a side rail of the ladder and a first portion upwardly extending from the housing and configured to attach to the bottom step at a location of the bottom step separated and apart from said rail; and a caster assembly integrally attached to the housing for allowing the ladder to roll and allowing the side rails of the ladder to contact ground and support a user when the user is on the ladder.

2. A caster apparatus as described in claim 1 wherein the caster assembly is only connected to the corner brace.

3. A caster apparatus as described in claim 2 including a ladder and wherein the caster assembly and corner brace are disposed such that a predetermined weight placed on the ladder prevents the ladder from rolling on the caster assembly.

4. A caster apparatus as described in claim 3 wherein the corner brace is comprised of said first portion, and said housing comprising a second portion connected to the first portion and a third portion connected to the second portion, said first portion attached to a bottom step of the ladder at the location on the bottom step separate and apart from said rail, said second portion attached to the caster assembly, said third portion attached to said rail of the ladder.

5. A caster apparatus as described in claim 4 wherein the first, second and third portions are one continuous piece.

6. A caster apparatus as described in claim 4 wherein the caster assembly is comprised of a caster stem extending in a supported sliding relationship through the second portion, a caster attached to a first end of the caster stem, a spring disposed around the caster stem for biasing the caster stem in an extended position, and a pin connected through the caster stem for compressing the spring as the caster stem slides through the second portion as a result of weight being placed on the ladder, said spring contained by the pin and second portion.

7. A caster apparatus as described in claim 6 wherein the first portion is comprised of a stem having a first end and a second end, said first end connected to and extending from the second portion and said second end connected to the bottom step; said second portion is comprised of a first and second sides each having an opening through which the caster stem slidably extends, said first and second sides in spaced relationship with each other; and said third portion connected to said first side.

8. A caster apparatus as described in claim 7 wherein the third portion is a connector which extends from the second side and connects to the side rail.

9. A ladder system comprising:

a ladder having side rails and a plurality of steps disposed between the side rails;

at least one brace for supporting a bottom step of the ladder, said corner brace having a housing attached to a side rail of the ladder and a first portion upwardly extending from the housing attached to the bottom step at a location on the bottom step separated and apart from said side rail; and at least one caster assembly integrally attached to the housing for allowing the ladder to roll and allowing the side rails of the ladder to contact ground and support a user when the user is on the ladder.

10. A ladder system as described in claim 9 wherein the caster assembly and corner brace are disposed on the ladder such that a predetermined weight placed on the ladder prevents the ladder from rolling on the caster assembly.

11. A ladder system as described in claim 10 wherein the ladder is comprised of a first side and a second side, said first side having a first rail and a second rail connected by a plurality of steps including a first bottom step, said second side connected to the first side, and having a third rail and a fourth rail connected by a plurality of steps including a second bottom step, said first bottom step having a first end connected to a first corner brace with a first caster assembly and a second end connected to a second corner brace with a second caster assembly, said second bottom step having a first end connected to a third corner brace with a third caster assembly and a second end connected to a fourth corner brace with a fourth caster assembly.

12. A ladder system as described in claim 11 wherein each corner brace is comprised of a first portion, a second portion connected to the first portion and a third portion connected to the second portion, said first portion attached to a bottom step of the ladder at the location on the bottom step separate and apart from said rail, said second portion attached to the caster assembly, said third portion attached to a rail of the ladder.

13. A ladder system as described in claim 12 wherein the first, second and third portions are one continuous piece.

14. A ladder system as described in claim 13 wherein each caster assembly is comprised of a caster stem extending in a supported sliding relationship through the second portion, a caster attached to a first end of the caster stem, a spring disposed around the caster stem for biasing the caster stem in an extended position, and a pin connected through the caster stem for compressing the spring as the caster stem slides through the third portion as a result of weight being placed on the ladder, said spring contained by the pin and the second portion.

15. A ladder system as described in claim 14 wherein the first portion is comprised of a stem having a first end and a second end, said first end connected to and extending from the second portion and said second end connected to the bottom step, said second portion comprising first and second sides each having an opening through which the caster stem slidably extends, said first and second sides in spaced relationship with each other and said third portion connected to said first side.

16. A caster apparatus for a ladder comprising:

a corner brace for supporting a bottom step of a ladder, said corner brace configured to attach to a side rail of the ladder and to the bottom step at a location on the bottom step separate and apart from said rail; and a caster assembly integrally attached to the corner brace for allowing the ladder to roll and allowing the side rails of the ladder to contact ground and support a user when the user is on the ladder, said caster assembly and corner brace are disposed such that a predetermined weight placed on the ladder prevents the ladder from rolling on the caster assembly, said corner brace is comprised of a first portion, a second portion connected to the first portion and a third portion connected to the second portion at the location on the bottom step separate and apart from said rail, said first portion attached to a bottom step of the ladder, said second portion attached to the caster assembly, said third portion attached to said rail of the ladder, said caster assembly is comprised of a caster stem extending in a supported sliding relationship through the second portion, a caster attached to a first end of the caster stem, a spring disposed around the caster stem for biasing the caster stem in an extended position, and a pin connected through the caster stem for compressing the spring as the caster stem slides through the second portion as a result of weight being placed on the ladder, said spring contained by the pin and second portion.

17. A ladder system comprising:

a ladder having side rails and a plurality of steps disposed between the side rails;

at least one corner brace for supporting a bottom step of the ladder, said corner brace attached to a side rail of the ladder and the bottom step at a location on the bottom step separate and apart from said side rail; and at least one caster assembly integrally attached to the corner brace for allowing the ladder to roll and allowing the side rails of the ladder to contact ground and support a user when the user is on the ladder, said caster assembly and corner brace are disposed on the ladder such that a predetermined weight placed on the ladder prevents the ladder from rolling on the caster assembly, said ladder is comprised of a first side and a second side, said first side having a first rail and a second rail connected by a plurality of steps including a first bottom step, said second side connected to the first side, and having a third rail and a fourth rail connected by a plurality of steps including a second bottom step, said first bottom step having a first end connected to a first corner brace with a first caster assembly and a second end connected to a second corner brace with a second caster assembly, said second bottom step having a first end connected to a third corner brace with a third caster assembly and a second end connected to a fourth corner brace with a fourth caster assembly, each corner brace is comprised of a first portion, a second portion connected to the first portion and a third portion connected to the second portion, said first portion attached to a bottom step of the ladder at the location on the bottom step separate and apart from said rail, said second portion attached to the caster assembly, said third portion attached to a rail of the ladder, each caster assembly is comprised of a caster stem extending in a supported sliding relationship through the second portion, a caster attached to a first end of the caster stem, a spring disposed around the caster stem for biasing the caster stem in an extended position, and a pin connected through the caster stem for compressing the spring as the caster stem slides through the third portion as a result of weight being placed on the ladder, said spring contained by the pin and the second portion.

* * * * *